US007416656B2

(12) United States Patent
Kuperman et al.

(10) Patent No.: US 7,416,656 B2
(45) Date of Patent: Aug. 26, 2008

(54) PROCESS FOR REMOVING ALUMINUM CONTAMINANTS FROM FISCHER-TROPSCH FEED STREAMS USING DICARBOXYLIC ACID

(75) Inventors: Alexander Kuperman, Orinda, CA (US); Lucy Melinda Bull, Pinole, CA (US); Dennis J. O'Rear, Petaluma, CA (US); Donald Kuehne, Hercules, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 601 days.

(21) Appl. No.: 10/886,320

(22) Filed: Jul. 7, 2004

(65) Prior Publication Data

US 2006/0006102 A1 Jan. 12, 2006

(51) Int. Cl.
*C10G 17/02* (2006.01)

(52) U.S. Cl. ..... 208/251 R; 208/252; 208/253

(58) Field of Classification Search ..... None
See application file for complete search history.

(56) References Cited

U.S. PATENT DOCUMENTS 4,853,109 A * 8/1989 Reynolds ..... 208/252

6,359,018 B1 3/2002 O'Rear et al.

* cited by examiner

*Primary Examiner*—Tam M. Nguyen
(74) *Attorney, Agent, or Firm*—A. Stephen Zavell; James W. Ambrosius

(57) ABSTRACT

A process for removing aluminum contaminants from the product of a Fischer-Tropsch synthesis reaction wherein said contaminants comprise at least 1 ppm of aluminum expressed as elemental metal in aluminum-containing contaminants having an effective diameter of less than 1 micron, said process comprising the steps of (a) collecting the contaminated Fischer-Tropsch product from the Fischer-Tropsch reactor; (b) forming a mixture comprising the contaminated Fischer-Tropsch product, at least an equal molar amount of a dicarboxylic acid containing from 2 to about 8 carbon atoms based upon the amount of aluminum present, and sufficient water for the dicarboxylic acid to form hydrogen ions; (c) maintaining the mixture under pre-selected conditions for a time sufficient for the aluminum contaminant and the dicarboxylic acid to form an aluminum containing precipitate having an effective diameter of greater than about 1 micron; (d) passing the mixture of step (c) through a particulate removal zone capable of removing substantially all of the aluminum-containing precipitate; and (e) recovering from the particulate removal zone a Fischer-Tropsch product containing less than about 1 ppm total aluminum.

16 Claims, No Drawings

PROCESS FOR REMOVING ALUMINUM CONTAMINANTS FROM FISCHER-TROPSCH FEED STREAMS USING DICARBOXYLIC ACID

FIELD OF THE INVENTION

This invention relates to a process for removing un-filterable aluminum-containing contaminants from a Fischer-Tropsch feed stream using a dicarboxylic acid.

BACKGROUND OF THE INVENTION

The majority of fuel today is derived from crude oil. Crude oil is in limited supply, and fuel derived from crude oil tends to include nitrogen-containing compounds and sulfur-containing compounds, which are believed to cause environmental problems such as acid rain.

Natural gas is abundant and may be converted into hydrocarbon fuels, lubricating oils, chemicals, and chemical feedstocks. One method for producing such products from natural gas involves converting the natural gas into synthesis gas ("syngas") which is primarily a mixture of hydrogen and carbon monoxide. In the Fischer-Tropsch process, the syngas produced from a natural gas source is converted into a product stream that includes a broad spectrum of products, including gases, such as, propane and butane; a liquid condensate which may be processed into transportation fuels; and wax which may be converted into base oils as well as lower boiling products, such as, diesel. The conversion of the wax and condensate usually involves passing the feed downwardly along with a co-current hydrogen enriched gas stream through a catalyst bed contained in one or more hydroprocessing reactors (i.e., a downflow reactor). The liquid hydrocarbon feed "trickles" down through the catalyst beds in the hydroprocessing reactor and exits the reactor bottom after the desired upgrading is achieved.

The Fischer-Tropsch feed stream as recovered from the Fischer-Tropsch reactor may contain filterable particulate contaminants, such as, for example, catalyst fines and rust and scale derived from the equipment. In addition, in some instances, un-filterable aluminum-containing contaminants have been found in the feed stream which cannot be removed using conventional particulate recovery methods. These un-filterable aluminum contaminants will coalesce into particulates under the conditions prevailing in a downstream hydroprocessing reactor and can cause serious operating difficulties in a fixed-bed, trickle-flow hydroprocessing reactor. The most frequent difficulty is pressure drop build-up and eventual plugging of the flow-paths through the catalyst beds as the catalyst pellets filter out the feed particulates. Such build-up can cause significant economic loss in lost production and replacement catalyst costs. These non-filterable aluminum-containing contaminants usually will concentrate in the heavier wax fraction of the Fischer-Tropsch product stream.

It would be advantageous to provide an efficient process for removing the un-filterable aluminum contaminants from the Fischer-Tropsch feed stream prior to the downstream hydroprocessing operations. The present invention provides such a process.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

SUMMARY OF THE INVENTION

The present invention is directed to a process for removing aluminum contaminants from the product of a Fischer-Tropsch synthesis reaction wherein said contaminants comprise at least 1 ppm of aluminum expressed as elemental metal in aluminum-containing contaminants having an effective diameter of less than 1 micron, said process comprising the steps of (a) collecting the contaminated Fischer-Tropsch product from the Fischer-Tropsch reactor; (b) forming a mixture comprising the contaminated Fischer-Tropsch product, at least an equal molar amount of a dicarboxylic acid containing from 2 to about 8 carbon atoms based upon the amount of aluminum present, and sufficient water for the dicarboxylic acid to form hydrogen ions; (c) maintaining the mixture under pre-selected conditions for a time sufficient for the aluminum contaminant and the dicarboxylic acid to form an aluminum containing precipitate having an effective diameter of greater than about 1 micron; (d) passing the mixture of step (c) through a particulate removal zone capable of removing substantially all of the aluminum-containing precipitate; and (e) recovering from the particulate removal zone a Fischer-Tropsch product containing less than about 1 ppm total aluminum.

Since the chemical composition of the aluminum-containing contaminant is not precisely known and likely includes various species, the amount of contaminant and/or contaminants present will be expressed as the amount of elemental aluminum. Thus when it is said that the Fischer-Tropsch product contains less than 1 ppm total aluminum, it should be understood that this refers to the amount of elemental metal present not to the total amount of contaminant.

It has been found that the un-filterable aluminum contaminant is usually concentrated in the higher molecular weight fractions of the Fischer-Tropsch product stream. The products from Fischer-Tropsch reactions generally will include a light reaction product and a waxy reaction product. The light reaction product, referred to as the condensate fraction, includes hydrocarbons boiling below about 700 degrees F. (e.g., tail gases through middle distillates) largely in the $C_5$ to $C_{20}$ range, with decreasing amounts up to about $C_{30}$. The waxy reaction product, referred to as the wax fraction, includes hydrocarbons boiling above about 600 degrees F. (e.g., vacuum gas oil through heavy paraffins), largely in the $C_{20}$ plus range, with decreasing amounts down to about $C_{10}$. It has been found that the un-filterable aluminum contaminant is usually concentrated in the higher molecular weight fractions of the Fischer-Tropsch product stream, especially in the wax fraction.

Although the process of the invention may be used with any type of Fischer-Tropsch reactor design, the invention is particularly advantageous when used with a slurry-type reactor where the wax fraction is recovered separately from the condensate fraction. Consequently, the wax fraction from the slurry reactor will contain the majority of the un-filterable aluminum.

Particularly useful in carrying out the present invention are the dicarboxylic acids selected from the group consisting of maleic acid, fumaric acid, succinic acid, adipic acid, and oxalic acid. As explained below, dicarboxylic acids having relatively low melting points are generally preferred. For this reason, maleic acid is especially preferred in carrying out the present invention. Accordingly, the invention is also directed to a process for removing aluminum contaminants from the wax fraction recovered from a Fischer-Tropsch synthesis reaction wherein said contaminants comprise at least 1 ppm of aluminum expressed as elemental metal in aluminum-containing contaminants having an effective diameter of less than 1 micron, said process comprising the steps of (a) collecting the contaminated Fischer-Tropsch wax fraction from the Fischer-Tropsch reactor; (b) forming a mixture comprising the contaminated Fischer-Tropsch wax fraction, at least an equal molar amount of maleic acid based upon the amount of aluminum present, and at least 0.1 weight percent water; (c) maintaining the mixture at a temperature above about 80 degrees C. and below about 250 degrees C. for a time sufficient for the aluminum contaminant and the maleic acid to form an aluminum containing precipitate having an effective diameter of greater than about 1 micron; (d) passing the mixture of step (c) through a particulate removal zone capable of removing substantially all of the aluminum-containing precipitate; and (e) recovering from the particulate removal zone a Fischer-Tropsch product containing less than about 1 ppm total aluminum.

As already noted, at least some of the aluminum contaminant in the Fischer-Tropsch feed stream may be in a form which cannot be readily removed by using filtration or other common methods for removing particulates from a liquid. Therefore, when this disclosure refers to an aluminum-containing contaminant having an effective diameter of less than 1 micron what is being referred to is an aluminum contaminant which may be in the form of a soluble aluminum compound, colloidal particles, or ultra-fine particulates. An effective diameter of 1 micron was selected as the distinguishing characteristic of the aluminum contaminant, because particles smaller than 1 micron generally are not capable of removal using conventional commercial filtering methods which are suitable for use with liquid hydrocarbons. Consequently, the aluminum contaminants are in a form which cannot be removed by a filter having an effective porosity of about 1 micron. While filtering is the preferred method for removing particles from both the Fischer-Tropsch feed stream, other methods such as centrifugation or distillation may also be employed, if so desired.

DETAILED DESCRIPTION OF THE INVENTION

In order to prevent plugging of the downstream hydroprocessing reactors, it is necessary to reduce the amount of aluminum in the Fischer-Tropsch product to about 1 ppm or less when expressed as elemental metal. Accordingly, in the present invention it is necessary to add at least an equal molar amount of the dicarboxylic acid based upon the aluminum content. In other words there should be sufficient dicarboxylic acid present to remove substantially all of the aluminum-containing contaminants in the feed. Generally, excess dicarboxylic acid will be added to the mixture to assure that the aluminum contaminant in the Fischer-Tropsch product is reduced to the lowest practical level.

The dicarboxylic acid may be added to the mixture as the acid or as a reagent which will form the acid in-situ. For example, maleic acid may be added to the mixture in the form of maleic anhydride provided there is sufficient water present in the mixture to form the active acid. Certain inactive reagents will decompose into active dicarboxylic acids under the conditions under which the reaction mixture is maintained. For example, citric acid, which is a tricarboxylic acid that is inactive in itself, will decompose into active dicarboxylic acid species at a temperature above about 170 degrees C.

Sufficient water must be present in the mixture to ionize the dicarboxylic acid and assist in the distribution of the acid throughout the mixture. Preferably the mixture should contain about 0.1 weight percent or more of water, and more preferably the mixture will contain about 0.5 weight percent or more of water. Generally, the Fischer-Tropsch product as recovered from the Fischer-Tropsch synthesis reactor will contain some water. Therefore, in practice, it may be unnecessary to add additional water to the mixture.

The mixture comprising the contaminated Fischer-Tropsch product, the dicarboxylic acid, and water must be sufficiently mixed to assure good dispersal of the acid throughout the Fischer-Tropsch product and contact between the acid and the aluminum-containing species. The formation of the filterable aluminum-containing particles has been found to be dependent upon the stirring rate. As noted below, the temperature of the reaction mixture may also contribute to the dispersal of the dicarboxylic acid.

The reaction between the aluminum-containing contaminants and the dicarboxylic acid takes place over a broad temperature range, although temperatures above ambient are usually preferred. As with most chemical reactions of this nature, higher temperatures tend to increase the speed of reaction which results in shorter residence times. Other factors also may be important in determining the optimal reaction temperature at which to maintain the mixture in order to facilitate the formation of the filterable aluminum-containing particles. For example, if the Fischer-Tropsch product is a wax fraction, the temperature of the mixture should be maintained above the initial melting point of the wax. The melting point of Fischer-Tropsch wax will vary depending upon the particular wax cut being treated. However, Fischer-Tropsch wax, i.e., $C_{20}$ plus Fischer-Tropsch hydrocarbons, generally has a melting point above about 80 degrees C. which represents the minimum temperature at which a mixture containing wax should be maintained. Above about 250 degrees C. Fischer-Tropsch wax or other hydrocarbons will begin to degrade due to oxidation, so temperatures above about 250 degrees C. are usually not desirable.

It has also been found that the reaction between the dicarboxylic acid and the aluminum-containing contaminant is enhanced if the mixture is maintained at a temperature in excess of the melting point of the dicarboxylic acid. While not wishing to be bound to any particular theory as to why the melt temperature is desirable, it is believed that the dicarboxylic in its molten state is more easily dispersed throughout the mixture. For this reason, Maleic acid is particularly preferred as the dicarboxylic acid, at least partially, because it has a melting point of 131 degrees C. and is stable to a temperature above 250 degrees C., the maximum temperature that it is practical to operate without degrading the product.

Depending on the type of Fischer-Tropsch reactor or the down-stream processing scheme, the wax fraction and the liquid condensate may be recovered from the Fischer-Tropsch reactor as a single product stream or as separate feed streams. In a process scheme employing a slurry-type Fischer-Tropsch reactor, the wax fraction is usually collected separately from the condensate and gaseous fractions. Since the aluminum-containing contaminate is usually concentrated in the wax fraction, the process described herein is particularly advantageous when used as part of a slurry-type reactor processing scheme because only the wax fraction needs to be treated in this instance. Thus the aluminum-containing contaminant needs to be removed from a lesser volume of Fischer-Tropsch product then if the entire Fischer-Tropsch synthesis product required treatment.

The time required to form the filterable particles will vary depending upon factors already discussed, such as the amount of carboxylic acid present, temperature, the volume of Fischer-Tropsch product being treated, degree of mixing, etc. Simply stated the optimal residence time is that minimum time period necessary to lower the amount of the aluminum-containing contaminants in the Fischer-Tropsch product to the desired level under the conditions selected to maintain the mixture.

The conditions under which the mixture comprising the contaminated Fischer-Tropsch product, the dicarboxylic acid, and water should be maintained preferably will be those conditions under which substantially all of the aluminum present in the feed will form a precipitate having an effective diameter of at least 1 micron. Particles smaller than about 1 micron are difficult to remove using conventional commercial equipment. Using the information in this disclosure one skilled in the art through routine experimentation should be able to optimize the conditions necessary to remove substantially all of the aluminum-containing contaminants.

The removal of the aluminum containing particles in the particulate removal zone will usually be accomplished by filtration. However, other methods for removing the particulates, such as centrifugation or distillation may also be used if desired. Regardless of the method employed substantially all of the particulates present in the mixture should be removed to protect the downstream hydroprocessing reactors from being plugged up. By employing the process of the invention a Fischer-Tropsch feed stream is produced which may be readily upgraded using conventional hydroprocessing methods without the disadvantage of having contaminants plug the reactors.

The following example is intended to further illustrate one embodiment of the invention but is not intended to be limitation on the scope of the invention.

EXAMPLE 0.1125 grams of maleic acid (Aldrich, 99%) were dissolved in 0.4785 grams of deionized water. 45.0 g of Fischer-Tropsch wax containing about 35 ppm of aluminum (determined as the elemental metal) was placed into a 220 ml glass liner and heated in a water bath to about 95 degrees C. The solution of maleic acid in water was added to the molten wax with vigorous agitation. The agitation was continued for additional 15 minutes. Then the liner was placed into a Parr™ reactor. The head space in the reactor was purged with nitrogen. The reactor was pressurized with nitrogen to about 30 psi and heated to 185 degrees C. with stirring at 500 rpm. After an hour at 185 degrees C. the reactor was cooled down to about 100 degrees C. The liner with the wax was removed from the reactor and cooled down to room temperature. The following day the wax was reheated, filtered through 0.1 micron filter and submitted for aluminum analysis by ICP. The aluminum (as elemental metal) content of the wax sample was found to be 0.75 ppm.

What is claimed is:

1. A process for removing aluminum contaminants from the product of a Fischer-Tropsch synthesis reaction wherein said contaminants comprise at least 1 ppm of aluminum expressed as elemental metal in aluminum-containing contaminants having an effective diameter of less than 1 micron, said process comprising the steps of:

(a) collecting the contaminated Fischer-Tropsch product from the Fischer-Tropsch reactor;

(b) forming a mixture comprising the contaminated Fischer-Tropsch product, at least an equal molar amount of a dicarboxylic acid containing from 2 to about 8 carbon atoms based upon the amount of aluminum present, and sufficient water for the dicarboxylic acid to form hydrogen ions;

(c) maintaining the mixture under pre-selected conditions for a time sufficient for the aluminum contaminant and the dicarboxylic acid to form an aluminum containing precipitate having an effective diameter of greater than about 1 micron;

(d) passing the mixture of step (c) through a particulate removal zone capable of removing substantially all of the aluminum-containing precipitate; and (e) recovering from the particulate removal zone a Fischer-Tropsch product containing less than about 1 ppm total aluminum.

2. The process of claim 1 wherein the Fischer-Tropsch synthesis reaction is carried out in a slurry-type reactor.

3. The process of claim 1 wherein the dicarboxylic acid is selected from the group consisting of maleic acid, fumaric acid, succinic acid, adipic acid, and oxalic acid.

4. The process of claim 1 wherein the contaminated Fischer-Tropsch product is the wax fraction from the Fischer-Tropsch synthesis reaction.

5. The process of claim 1 wherein the mixture formed in step (b) contains at least 0.1 weight percent water.

6. The process of claim 1 wherein the mixture formed in step (b) contains at least 0.5 weight percent water.

7. The process of claim 1 wherein the temperature of the mixture in step (c) is maintained below about 250 degrees C.

8. The process of claim 7 wherein the mixture is maintained at a temperature above about 80 degrees C.

9. The process of claim 7 wherein the mixture is maintained at a temperature above the melting point of the dicarboxylic acid.

10. The process of claim 9 wherein the dicarboxlic acid is maleic acid.

11. The process of claim 1 wherein the aluminum-containing precipitate is removed from the mixture in step (d) by filtration.

12. A process for removing aluminum contaminants from the wax fraction recovered from a Fischer-Tropsch synthesis reaction wherein said contaminants comprise at least 1 ppm of aluminum expressed as elemental metal in aluminum-containing contaminants having an effective diameter of less than 1 micron, said process comprising the steps of:

(a) collecting the contaminated Fischer-Tropsch wax fraction from the Fischer-Tropsch reactor;

(b) forming a mixture comprising the contaminated Fischer-Tropsch wax fraction, at least an equal molar amount of maleic acid based upon the amount of aluminum present and at least 0.1 weight percent water;

(c) maintaining the mixture at a temperature above about 80 degrees C. and below about 250 degrees C. for a time sufficient for the aluminum contaminant and the maleic acid to form an aluminum containing precipitate having an effective diameter of greater than about 1 micron;

(d) passing the mixture of step (c) through a particulate removal zone capable of removing substantially all of the aluminum-containing precipitate; and (e) recovering from the particulate removal zone a Fischer-Tropsch product containing less than about 1 ppm total aluminum.

13. The process of claim 12 wherein the mixture formed in step (b) contains at least 0.5 weight percent water.

14. The process of claim 12 wherein the Fischer-Tropsch synthesis reaction is carried out in slurry type reactor.

15. The process of claim 12 wherein the temperature of the mixture in step (c) is maintained above the melting point of the maleic acid.

16. The process of claim 12 wherein the aluminum-containing precipitate is removed from the mixture in step (d) by filtration.

* * * * *